US008151826B2

(12) United States Patent
Dan

(10) Patent No.: US 8,151,826 B2
(45) Date of Patent: Apr. 10, 2012

(54) WATER-SAVING SWITCH EQUIPMENT

(75) Inventor: Tangjun Dan, Fujian (CN)

(73) Assignee: Xiamen Clease Industries Co., Ltd., Xiamen (CN)

( * ) Notice: Subject to any disclaimer, the term of this patent is extended or adjusted under 35 U.S.C. 154(b) by 0 days.

(21) Appl. No.: 12/922,216

(22) PCT Filed: Aug. 28, 2009

(86) PCT No.: PCT/CN2009/073604

§ 371 (c)(1),
(2), (4) Date: Sep. 13, 2010

(87) PCT Pub. No.: WO2010/031300

PCT Pub. Date: Mar. 25, 2010

(65) Prior Publication Data

US 2011/0155940 A1 Jun. 30, 2011

(30) Foreign Application Priority Data

Sep. 16, 2008 (CN) ..... 2008 2 0145597 U

(51) Int. Cl.
*F15D 1/04* (2006.01)

(52) U.S. Cl. ..... 138/43; 138/46; 222/511

(58) Field of Classification Search ..... 138/43, 138/45, 46; 222/511
See application file for complete search history.

(56) References Cited

U.S. PATENT DOCUMENTS

| | | | | | |
|---|---|---|---|---|---|
| 3,842,857 | A | * | 10/1974 | McCornack | 137/242 |
| 3,863,673 | A | * | 2/1975 | Sitton | 137/614.11 |
| 3,965,922 | A | * | 6/1976 | McCornack | 137/218 |
| 4,313,466 | A | * | 2/1982 | Adams | 137/614.17 |
| 4,570,857 | A | * | 2/1986 | Rosenberg | 239/382 |
| 4,624,443 | A | * | 11/1986 | Eidsmore | 251/65 |
| 4,995,534 | A | * | 2/1991 | Norman | 222/511 |

FOREIGN PATENT DOCUMENTS

| | | | |
|---|---|---|---|
| CN | 2093273 | U | 1/1992 |
| CN | 200999867 | Y | 1/2008 |
| CN | 201162870 | Y | 12/2008 |
| CN | 201326200 | Y | 10/2009 |
| JP | 10073195 | A | 3/1998 |

* cited by examiner

*Primary Examiner* — Patrick F Brinson
(74) *Attorney, Agent, or Firm* — Rabin & Berdo, P.C.

(57) ABSTRACT

A water-saving switch equipment, which arranged in the outlet of a tap body, includes a button arranged in the button groove of the tap body, and a water-saving piece arranged under the button. The water-saving piece has a piece which is in the chamber of the outlet. The water-saving switch equipment may adjust the water output without switching on or off the tap's spool.

3 Claims, 2 Drawing Sheets

WATER-SAVING SWITCH EQUIPMENT

FIELD OF THE INVENTION

The present invention relates to a water-saving switch equipment, especially relates to the water-saving switch equipment used in the outlet of the tap or other water output devices.

BACKGROUND OF THE INVENTION

In the existing technique, when it needs to adjust the water output of the tap or other water output devices, the user has to lift or press the tap switch, the tap switch will control the movement of the spool to reduce the water output, thus the water is saved, other tap switches may control the movement of the spool by rotating. However, no matter what kinds of manners are applied for controlling the movement of the spool, the states of two terminal movements of the tap switch are no water output and maximum water output, moreover, because the spool is in the water inlet of the tap, so when the spool is controlled to adjust the water output, it will be easy to close the water or increase the water output suddenly due to the difficult of handling the operation strength, it is not convenient for operation.

SUMMARY OF THE INVENTION

The objective of the present invention is to provide a water-saving switch equipment which is disposed in the outlet of the tap and convenient for operation.

In order to solve the above technical problems, the technical solution applied by the present invention is:

A water-saving switch equipment, which is arranged in the outlet of a tap body, includes a button arranged in the button groove of the tap body, and a water-saving piece arranged under the button, the water-saving piece has a piece which is in the chamber of the outlet.

Said water-saving piece has a guiding groove; a guiding plate is fixed in the chamber of the outlet of the tap body and has a guiding rod inserted in the guiding groove of the water-saving piece.

A spring is set between said water-saving piece and the tap body for the reposition of the water-saving piece.

After applying the above technical solution, since the present invention further disposes a switch equipment with a button, so the button of said water-saving switch equipment can be applied to reduce the water output when the tap is used, so it doesn't need to switch on or off the spool to save water, the operation is more convenient.

DETAILED DESCRIPTION OF THE EMBODIMENTS

The present invention will become apparent with the reference of the accompanying drawings and the preferred embodiments.

Figure 1:
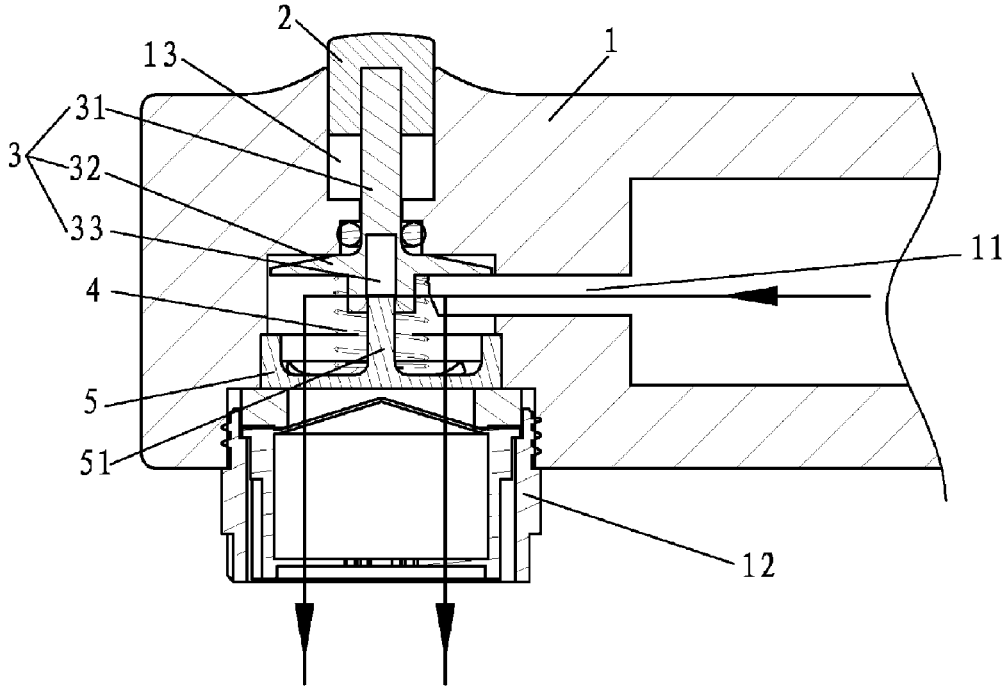
FIG. 1 is the structural view of the first embodiment of the present invention.
Figure 2:
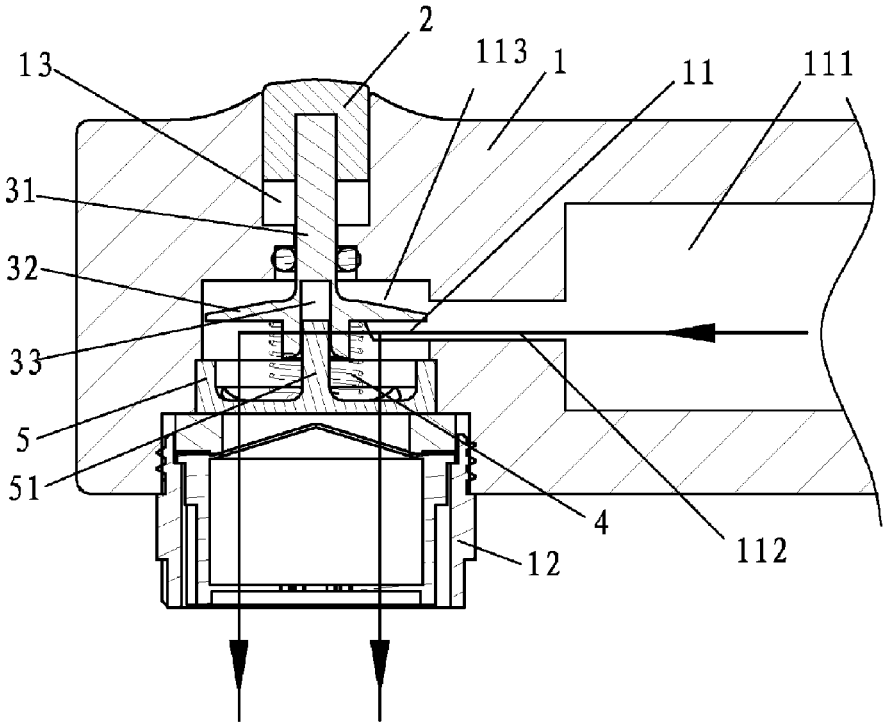
FIG. 2 is the structural view of the first embodiment of the present invention when it is in the water-saving status.

First embodiment, as showed in FIG. 1 and FIG. 2, the water-saving switch equipment of the present invention is disposed in the outlet 11 of the tap body 1, comprising a button 2, a water-saving piece 3, spring 4 and a guiding plate 5. Wherein:

The outlet 11 is disposed in said tap body 1: it comprises a horizontal waterway 111, a water guiding pipe 112 and a vertical outlet 113; the horizontal waterway 111 is horizontally disposed in the tap body 1 and communicates with a water input pipe; the water guiding pipe 112 is connected to the front end portion of the horizontal waterway 111, the diameter of the water guiding pipe 112 is smaller than the diameter of the horizontal waterway 111; the vertical outlet 113 is vertically disposed on the lower end of the front portion of the tap body 1, an interval is set between the upper end surface of the vertical outlet 113 and the upper end of the water guiding pipe 112; the upper end of the front portion of the tap body 1 has a button groove 13, the lower end of which communicates with the vertical outlet 113; the end portions of the vertical outlet 113 can be respectively disposed with a wave generator 12 for generating the bubble water or the gentle water.

Said button 2 is disposed in the button groove 13 of the tap body 1.

Said water-saving piece 3 comprises a rod 31 and a piece 32, the rod 31 is installed under said button 2, the piece 32 is disposed in the chamber of the vertical outlet 113 of the tap body 1, the lower portion of said water-saving piece 3 further has a guiding groove 33. The thickness of the water-saving piece 3 is adapted with the interval between the upper end surface of the vertical outlet 113 and the upper end of the water guiding pipe 112.

Said guiding plate 5 is fixed in the lower portion of the chamber of the vertical outlet 113 of the tap body 1, a guiding rod 51 is disposed above said guiding plate 5 and inserted in the guiding groove 33 of the water-saving piece 3 for guiding and adjusting the water-saving piece 3.

Said spring 4 is disposed between the water-saving piece 3 and the guiding plate 5, the embodiment showed in the figs is this kind of structure.

Said spring 4 is disposed between the water-saving piece 3 and the tap body 1 for the reposition of the water-saving piece 3.

When the tap is operated, firstly presses the button 2, the button 2 will drive the water-saving piece 3 move downward, the piece 32 of the water-saving piece 3 will partly seal the chamber of the vertical outlet 113, so the flow area of the water guiding pipe 112 will become smaller, as showed in FIG. 2, thereby the water output will be reduced, the water will be saved.

It is necessary to state that, if there are multiple press gears designed on the button, then the flow area of the outlet will be changed variously by the piece of the water-saving piece, the water output will be adjusted according to multiple gears.

Figure 3:
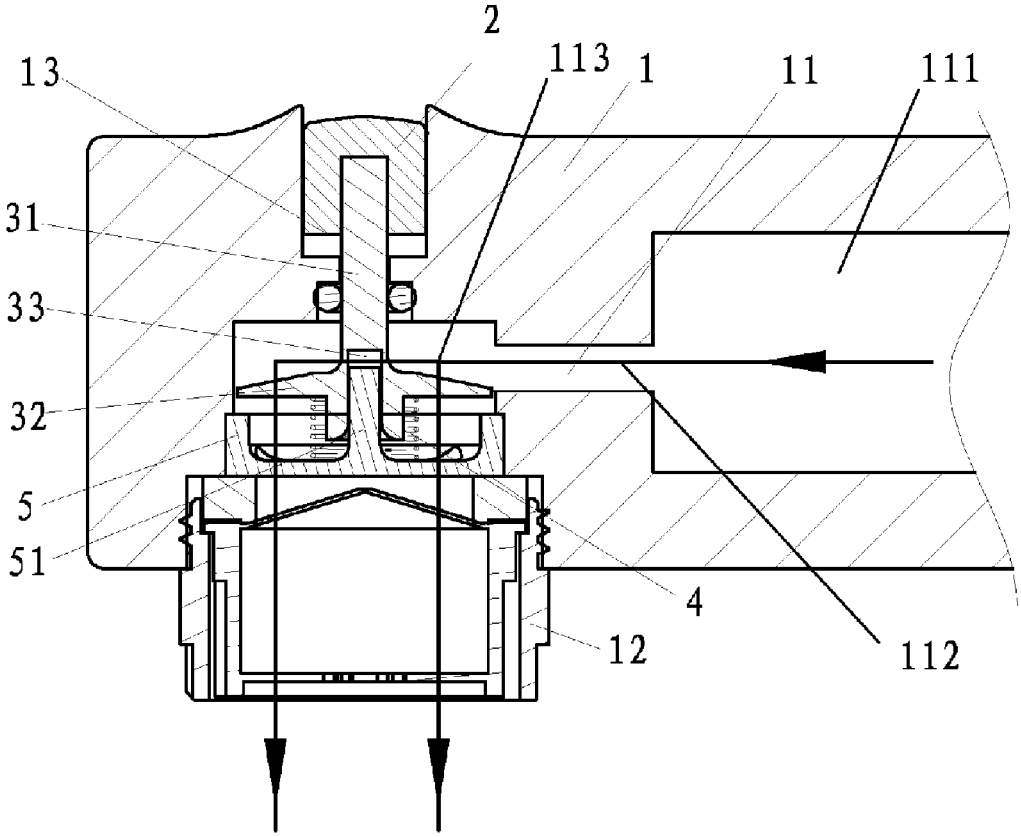
FIG. 3 is the structural view of the second embodiment of the present invention when it is in the water-saving status.
Figure 4:
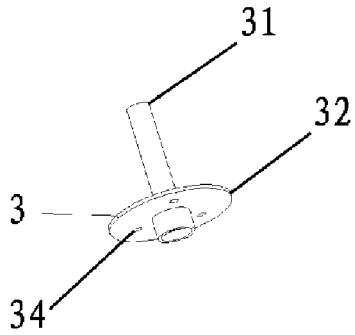
FIG. 4 is the structural view of water-saving piece of the second embodiment of the present invention.

Second embodiment, as showed in FIG. 3 and FIG. 4, the difference between the embodiment 1 and embodiment 2 lies in that, there are a plurality of through holes 34 on the piece 32 of the water-saving piece 3, when the user wants to save water, he can firstly press the button 2, the button 2 will drive the water-saving piece 3 move downward, the piece 32 of the water-saving piece 3 will seal the vertical outlet 113, so the water will flow into the chamber upon the water-saving piece 3 through the water guiding pipe 112 and flow out of the through holes 34 of the water-saving piece 3, as showed in FIG. 3, thereby the water output will be reduced, the water will be saved.

INDUSTRIAL APPLICABILITY

The water-saving switch equipment of the present invention is disposed in the outlet of the tap body, includes a button arranged in the button groove of the tap body, and a water-saving piece arranged under the button, the water-saving piece has a piece which is in the chamber of the outlet, the water output will be effectively controlled, the operation is convenient, the structure is simple, it has a good industrial applicability.

What is claimed is:

1. A water-saving switch equipment, which is arranged in the outlet of a tap body, and including a button arranged in a button groove of the tap body, and a water-saving piece arranged under the button, the water-saving piece having a piece which is in a chamber of the outlet;

wherein said water-saving piece has a guiding groove; a guiding plate is fixed in the chamber of the outlet of the tap body and has a guiding rod inserted in the guiding groove of the water-saving piece;

wherein a spring is set between said water-saving piece and the tap body for the reposition of the water-saving piece; and wherein said water-saving piece has a plurality of through holes.

2. The water-saving switch equipment according to claim 1, wherein when said button is pressed, the piece of the water-saving piece will seal the chamber of the outlet, and the water will flow out of the through holes.

3. A water-saving switch arrangement, comprising:

a tap body having a button groove, and an outlet having a chamber; and a water-saving switch disposed in the outlet, and including:

a button disposed in the button groove;

a water-saving piece having a plurality of through holes, and being disposed under the button, the water-saving piece comprising:

a piece disposed in the chamber of the outlet; and a guiding groove;

a guiding plate fixed in the chamber, the guiding plate having a guiding rod inserted in the guiding groove of the water-saving piece; and a spring set between the water-saving piece and the tap body for repositioning the water-saving piece.

* * * * *